United States Patent [19]

Katsumata

[11] 3,948,239

[45] Apr. 6, 1976

[54] SIGNAL GENERATOR FOR USE IN A BREAKERLESS IGNITION SYSTEM FOR AN INTERNAL COMBUSTION ENGINE

[75] Inventor: Mitsuo Katsumata, Numazu, Japan

[73] Assignee: Kokusan Denki Co., Ltd., Numazu, Japan

[22] Filed: Dec. 2, 1974

[21] Appl. No.: 528,678

[30] Foreign Application Priority Data

Dec. 6, 1973 Japan ..... 48-139145[U]

[52] U.S. Cl... 123/149 C; 123/146.5 A; 123/149 D; 310/70 R; 315/209 SC

[51] Int. Cl.² ..... F02P 5/00; F02P 3/06

[58] Field of Search ..... 123/149 R, 149 D, 149 C, 123/149 A, 149 F, 148 E, 146.5 A; 310/70 R, 70 A, 153, 156; 315/209 SC, 218

[56] References Cited

UNITED STATES PATENTS

| | | | |
|---|---|---|---|
| 3,465,739 | 9/1969 | Burson | 123/149 R |
| 3,598,098 | 8/1971 | Sohner et al. | 123/148 E |
| 3,661,132 | 5/1972 | Farr | 123/148 E |
| 3,705,573 | 12/1972 | Palazzetti et al. | 123/149 R X |
| 3,866,589 | 2/1975 | Haubner et al. | 123/148 E X |

*Primary Examiner*—Charles J. Myhre
*Assistant Examiner*—Tony Argenbright
*Attorney, Agent, or Firm*—Woodling, Krost, Granger & Rust

[57] ABSTRACT

A signal generator for use in a breakerless ignition system for an internal combustion engine, comprising a magnet rotor rotatable in synchronism with said internal combustion engine and a stator including a plurality of signal coils and a comb-like magnetic core member disposed adjacent to said rotor and having a plurality of teeth-like core portions around which said signal coils are wound, respectively, and a common yoke magnetically connected to said core portions, said signal coils constructed so that incremental voltages are established thereacross from the most advanced position toward the most retarded position and said signal coils divided into at least two series connections of at least alternate signal coils. Each series connection of signal coils has a diode connected in series to the corresponding series connection and the series connections of signal coils are arranged in a parallel manner. The signal generator is arranged so that one of the ends of the output is connected to a gate of a controlled semiconductor switching device in the breakerless ignition system and the other end of the output is connected to a cathode of the semiconductor switching device.

1 Claim, 11 Drawing Figures

SIGNAL GENERATOR FOR USE IN A BREAKERLESS IGNITION SYSTEM FOR AN INTERNAL COMBUSTION ENGINE

BACKGROUND OF THE INVENTION

A capacitor discharge type breakerless ignition system is well known which comprises a capacitor to charge an electric energy and a controlled semiconductor switching device to control the discharge of the electric energy through a primary coil of an ignition coil whereby a secondary coil of the ignition coil has a high voltage established thereacross. For this type of the ignition system is required a controlling signal applied to the semiconductor switching device in time with the operation of an engine and yet the signal is required to conduct the device in an advanced phase in accordance with the revolution number of the engine.

In general, a signal generator has been widely used which comprises a magnet rotor rotating in synchronism with the internal combustion engine and a stator fixed relative to the rotor to generate a signal. One of the prior signal generators has the stator provided with a plurality of coils wound around teeth of a comb-like magnetic core, and designed to induce a plurality of signals different in the amplitude from each other, respectively. Only one half wave portions of the signals from the respective coils have been picked up and combined with each other. The coils have been arranged so that the coil in the most retarded position induces the signal of the largest amplitude and the coil in the most advanced position induces the signal of the smallest amplitude. Combination of the signals from the respective coils have been effected through respective diodes connected in series to the corresponding coils. During relatively low number of revolution of the engine, the signal from the coil in the most retarded position reaches the gate-on level of the semiconductor switching device, resulting in conduction of the device in most retarded phase. During relatively high number of revolution of the engine, the signal from the coil in the most advanced position reaches the gate-on level of the semiconductor switching device, resulting in conduction of it in most advanced phase. The disadvantage of the prior art is that indivisual diodes have been required for the respective coils. As a result, the required number of the diodes increases as the number of the coils increases, which makes the ignition system expensive.

OBJECT OF THE INVENTION

Accordingly, it is a principal object of the present invention to provide a signal generator in which at least only two diodes are required even though the number of the coils increases so that the generator can be inexpensive.

It is another object of the present invention to provide a signal generator in which the signals from the coils can be compounded without any interference of the signal with each other.

SUMMARY OF THE INVENTION

In accordance with the present invention, there is provided a signal generator for use in a breakerless ignition system for an internal combustion engine, comprising a magnet rotor rotatable in synchronism with said internal combustion engine and a stator including a plurality of signal coils disposed in a magnetically and mechanically spaced relation from each other and a comb-like magnetic core number disposed adjacent to said rotor and having a plurality of teeth-like core portions around which said signal coils are wound, respectively, and a common yoke magnetically connected to said core portions, said signal coils constructed so that incremental voltages from said signal coils are established from the most advanced position to the most retarded position and said signal coils divided into at least two series connections of at least alternate signal coils, said series connections of signal coils each having a diode connected in series to the corresponding series connection and arranged in a parallel manner.

BRIEF DESCRIPTION OF THE DRAWING

The above and other objects and features of the present invention will be apparent from the description of the preferred embodiments taken with particular reference to the accompanying drawings in which.

DETAILED DESCRIPTION OF THE PREFERRED EMBODIMENTS

Figure 1:
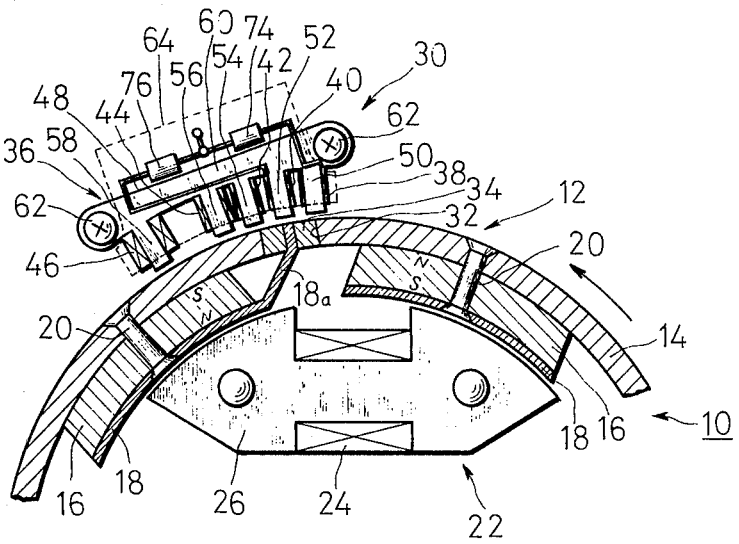
FIG. 1 is a fragmental view of a magneto generator provided with a signal generator of the present invention with a portion taken in a cross section.

Referring now to FIG. 1, there is shown a magneto generator indicated generally at numeral 10 and which is provided with a signal generator described later in more detail. The magneto generator 10 comprises a rotor 12 including a magnetic bowl-like flywheel 14 and a plurality of permanent magnets 16 disposed on the inner periphery of the flywheel 14 with respective sole pieces 18 disposed on the inner surface of the magnets while respective rivets 20 secure the magnets 16 and the pole pieces 18 to the flywheel 14 on the inner periphery thereof. The magneto generator 10 also comprises a stator 22 including a plurality of coil means one of which is indicated at numeral 24 in FIG. 1 and wound around an I-shaped magnetic core 26. The output of the coil means 24 may be used as igniting power for the ignition system and the outputs of the other coil means may be connected to a battery and/or a head lamp arrangement mounted on a car.

The signal generator 30 of the present invention may have the rotor 12 used also as a rotor for the generator 30. The rotor 12 may be provided with an extension 18*a* extending from one of the pole pieces 18 on the magnets 16. The extension 18*a* may extend through an opening 32 in the cylindrical wall of the bowl-like flywheel 14 in a magnetically insulated manner from the flywheel with a non-magnetic member 34 filled in the gap between the extension 18*a* and the inner surface of the opening 32 so that the extension 18*a* may be rigidly fixed while the rotor 12 is rotating. It will be understood that if the extension 18a itself is rigid, the non-magnetic member may be eliminated. It will be seen from FIG. 1 that the end of the extension 18*a* may be substantially flush with the outer periphery of the cylindrical wall of the flywheel 14. It should be noted that more than one extension may be provided in accordance with the number of the cylinders of the engine.

The signal generator 30 also comprises a stator 36 disposed without the flywheel 14 of the magneto generator 10 and operatively associated with the extension 18*a* of the rotor 12. The stator 36 comprises a plurality of signal coils 38, 40, 42, 44 and 46 spaced from each other peripherally of the flywheel. A comb-like magnetic core member 48 is provided and comprises a plurality of teeth-like core portions 50, 52, 54, 56 and 58 to be wound with the respective signal coils 38 to 46 and a common yoke 60 magnetically connecting one of the core portions 50 to 58 to the adjacent one. The comb-like core member 48 at both ends may be secured to a base (not shown) of the stator 22 by means of screws 62. The signal coils are designed so that incremental voltage signals from the signal coils are induced from the most advanced position to the most retarded position relative to rotation of the rotor 12 as indicated by an arrow in FIG. 1. In the illustrated embodiment, the signal coil 46 positioned in the most retarded phase has the largest number of turns and signal coil 38 positioned in the most advanced phase has the smallest number of turns. The number of turns of the other signal coils gradually increases toward the most retarded position. When the rotor 12 rotates about the axis, as the extension 18*a* at the end passes the respective core portions 50 to 58, magnetic flux variably flows from one of the magnets 16, through the corresponding pole piece 18 and the extension 18*a* to one of the core portions 50 to 58 and from another of the core portions 50 to 58, through the cylindrical wall of the flywheel 14 to the magnet 16. Thus, the signal coils 38 to 46 have respective signal voltages $E_{38}$, $E_{40}$, $E_{42}$, $E_{44}$, and $E_{46}$ induced therefrom as shown in FIGS. 3*a* to 3*e*. In the illustrated embodiment, the signal coil 46 may be spaced from the adjacent signal coil 44 at longer distance than that between the other adjacent ones. But it will be understood that the distances between the adjacent signal coils may be determined in accordance with the desirable advance characteristics.

It should be noted that instead of the varied number of turns of the signal coils, the magnetic gaps between the ends of the core portions and the outer periphery of the cylindrical wall of the flywheel 14 may vary so that the signal voltages from the respective signal coils gradually increase from the most advanced position to the most retarded position.

Figure 2:
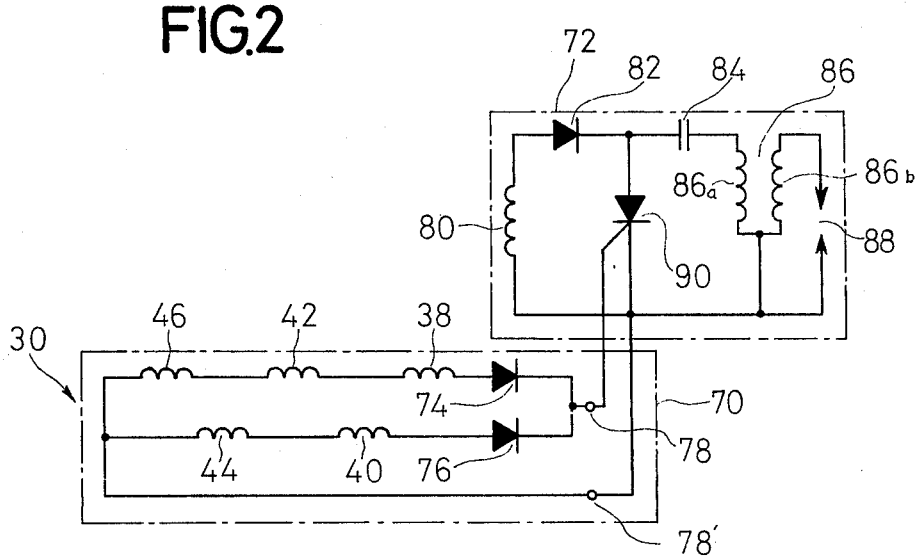
FIG. 2 is a schematic diagram of a breakerless ignition system including a signal generator of the present invention.
Figure 3A:
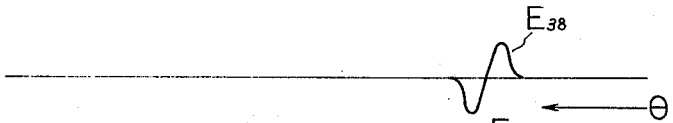
FIG. 3*a* to 3*h* show respective wave forms of the signals from the respective signal coils and wave forms of compound signals.
Figure 3B:
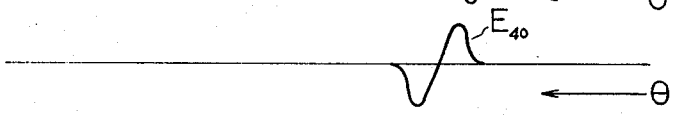
Figure 3C:
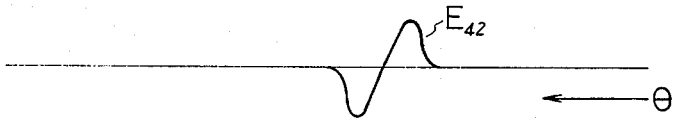
Figure 3D:
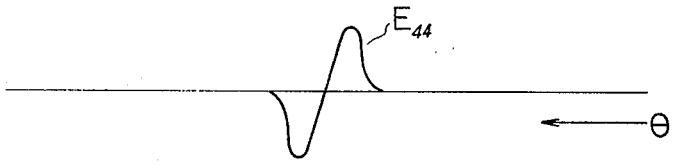
Figure 3E:
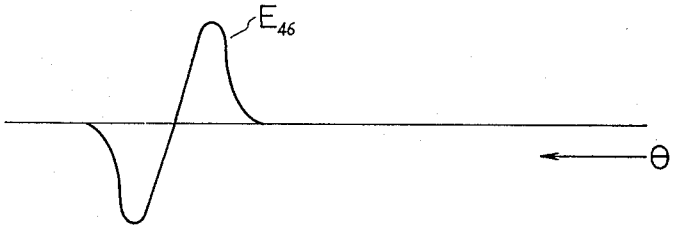
Figure 3F:
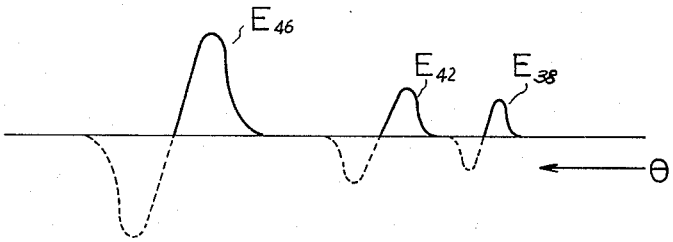
Figure 3G:
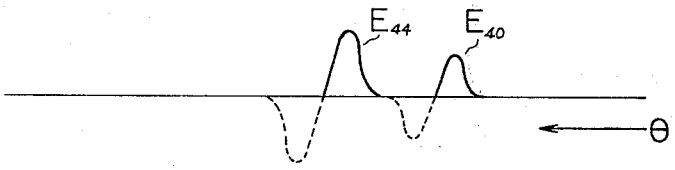
Figure 3H:
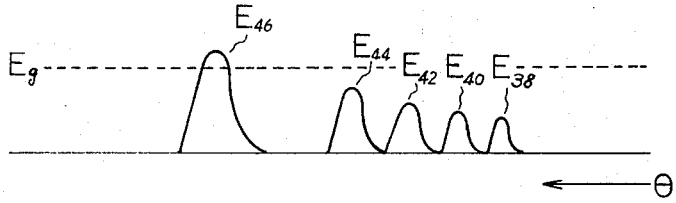

The output signals $E_{38}$ to $E_{46}$ are picked up in the form of only one half wave and compounded as shown in FIG. 3*h*. FIG. 2 shows a signal compound circuit 70 to compound the output signals $E_{38}$ to $E_{46}$ and the breakerless ignition system 72 associated with the signal compound circuit. As seen from the figure, the signal coils 38 to 46 may be divided into two series connections of at least alternate signal coils. One of the series connections includes alternate signal coils 38, 42 and 46 and the other series connection alternate signal coils 40 and 44. The series connections also include respective diodes 74 and 76, the anodes of which are connected to the signal coils 38 and 40, respectively and the cathodes of which are connected to a common output terminal 78. The series connections have the signal coils 46 and 44 connected to another common output terminal 78′. Thus, it will be noted that the series connections are connected in a parallel manner.

As a result, the series connection of signal coils 38, 42 and 46 produces the compound signal as shown in FIG. 3*f* and the other series connection of the signal coils 40 and 44 produces the compound signal as shown in FIG. 3*g*. The compound signals of FIGS. 3*f* and 3*g* are further compounded into a consecutive signal as shown in FIG. 3*h*. Provision of at least two series connections of the alternate signal coils is the most essential feature of the present invention. Such arrangement of the signal coils 38 to 46 allows the output signals $E_{38}$ to $E_{46}$ to be compounded without any interference which otherwise occurs. More particularly, if all the signal coils 38 to 46 are connected in series to each other, the negative half wave of the antecedent signal tends to interfere with the positive half wave of the decedent signal. With the feature of the present invention such interference can be avoided. In addition, the arrangement of the signal coils allows the close space from one of the signal coils to the adjacent one, resulting in the possibility to make the advanced operation minute.

The breakerless ignition system 72 associated with the signal generator 30 may be conventional and comprises an ignition power source 80, a diode 82 with the anode connected to the power source at one end, a capacitor 84 with one end connected to the cathode of the diode 82, an ignition coil 86 including a primary coil portion 86*a* with one end connected to the other end of the capacitor 84 and with the other end connected to the other end of the power source 80 and a secondary coil portion 86*b* with both ends connected to an ignition plug 88, and a semiconductor switching device such as thyristor 90 to control the discharge of the capacitor 84 through the primary coil portion 86*a* of the ignition coil 86. The output terminals 78 and 78′ of the signal generator or signal compound circuit 70 are connected to the gate and cathode of the thyristor 90, respectively. The operation of the ignition system 72 is as conventional and, therefore, will not need further explanation.

Figure 4:
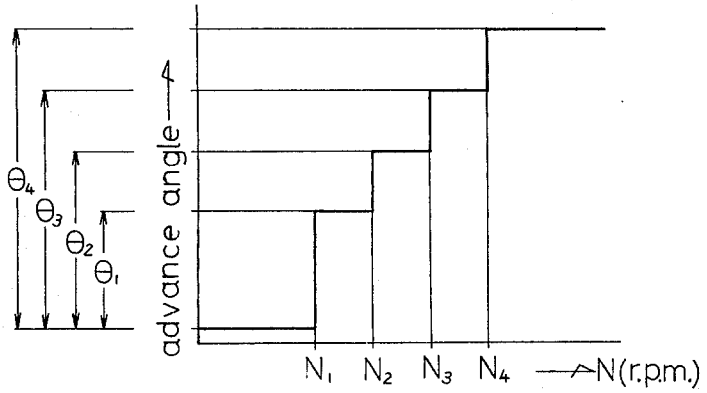
FIG. 4 shows the manner in which the advance operation of the ignition system is effected with the increased number of revolution of the engine.

In operation, during low revolution number of the engine, only the output signal $E_{46}$ from the signal coil 46 in the most retarded position reaches the gate-on level $E_g$ of the thyristor 90. Therefore, the signal generator 30 controls the conduction of the thyristor 90 so that the ignition system ignites the engine in most retarded phase. As the revolution number of the engine rises, since the output signals $E_{44}$, $E_{42}$ and $E_{40}$ from the signal coils 44, 42 and 40 in more advanced positions sequentially reaches the gate-on level $E_g$ of the thyristor 90, the ignition system 72 ignites the engine in more advanced phase. During highest revolution number of the engine, the output signal $E_{38}$ from the signal coil 38 in the most advanced position reaches the gate-on level of the thyristor 90 and therefore the ignition system ignites the engine in most advanced phase. FIG. 4 shows the manner in which the ignition phase is sequentially advanced. In this figure, $N_1$, $N_2$, $N_3$ and $N_4$ designate the revolution number of the engine when the output signals $E_{46}$ to $E_{38}$ reach the gate-on level of the thyristor 90 and $\theta_1$, $\theta_2$, $\theta_3$ and $\theta_4$ designate the advance angle for the respective revolution number of the engine. It will be seen from FIG. 4 that the advance angle steppingly varies with the revolution number of the engine. Such advance characteristic can vary based on the number of the signal coils, the number of turns of the signal coils, the gap between the core portions of the comb-like core member and the extension 18*a* of the rotor 12 and the distances between the adjacent signal coils. Thus, the most preferable advance characteristic can be determined in accordance with the characteristic of the engine.

Referring again to FIG. 1, it is preferable that the diodes 74 and 76 may be mounted on or adjacent to the comb-like core member 48 and that a mould 64 of synthetic resin may be provided over the assembly of the signal coils, the magnetic core member 48 and the diodes 74 and 76 as indicated by dotted line in FIG. 1. Thus, wiring leads for connection will be sustantially decreased and the assembly will be prevented from breakage due to the vibration.

While some preferred embodiments have been described in detail with reference to the accompanying drawings, it will be apparent that they are by way of illustration and that various changes and modifications may be made within the spirit and scope of the invention, which is intended to be defined only to the appended claims.

What is claimed is:

1. A signal generator for use in a breakerless ignition system for an internal combustion engine, comprising a magnet rotor rotatable in synchronism with said internal combustion engine and a stator including a plurality of signal coils disposed in a magnetically and mechanically spaced relation from each other and a comb-like magnetic core member disposed adjacent to said rotor and having a plurality of teeth-like core portions around which said signal coils are wound, respectively, and a common yoke magnetically connected to said core portions, said signal coils constructed so that incremental voltages from said signal coils are established from the most advanced position to the most retarded position and said signal coils divided into at least two series connections of at least alternate signal coils, said series connections of signal coils each having a diode connected in series to the corresponding series connection and arranged in a parallel manner, and said signal coils having the number of turns gradually increasing from the most advanced position to the most retarded position relative to rotation of said rotor.

* * * * *